United States Patent [19]

Smith

[11] 4,432,106

[45] Feb. 21, 1984

[54] CLAMP ASSEMBLY FOR SELF-RIMMING SINKS OR BASINS

[75] Inventor: Ronald A. Smith, Willowdale, Canada

[73] Assignee: Arro-Mac Manufacturing Inc., Mississauga, Canada

[21] Appl. No.: 420,266

[22] Filed: Sep. 20, 1982

[30] Foreign Application Priority Data

Jun. 23, 1982 [CA] Canada ..... 405816

[51] Int. Cl.[3] ..... A47K 3/16; E03C 1/33

[52] U.S. Cl. ..... 4/633; 4/634

[58] Field of Search ..... 4/633, 631, 634, 632, 4/636, 191–192

[56] References Cited

U.S. PATENT DOCUMENTS

| | | | |
|---|---|---|---|
| 2,846,695 | 8/1958 | Hartog | 4/633 |
| 2,925,609 | 2/1960 | Richardson | 4/633 |
| 3,014,476 | 12/1961 | Barnatt | 4/634 X |
| 3,029,445 | 4/1962 | Just | 4/633 |
| 3,365,732 | 1/1968 | Juergens et al. | 4/634 |
| 3,613,128 | 10/1971 | Moyer | 4/633 |
| 3,813,707 | 6/1974 | Fowell | 4/633 X |
| 4,175,292 | 11/1979 | Morrison | 4/633 X |

*Primary Examiner*—Henry K. Artis

*Attorney, Agent, or Firm*—Donald E. Hewson

[57] ABSTRACT

A clamp assembly is provided for self-rimming sinks or basins which mount through an opening in a supporting counter structure, where the sink or basin has a plurality of brackets secured at least intermittently around its periphery at positions that are intermediate the height of the bowl. A clamp structure has a generally L-shaped configuration, with a first horizontal arm and a second vertical leg, and a bolt threadably received in and passed through the horizontal arm. Means are provided at the upper end of the bolt for engaging the under surface of the counter. The lower portion of the leg is offset in a direction away from the arm so as to contact the outer surface of the bowl of the basin or sink at a position below the bracket, whereby the bolt is kept in a substantially vertical orientation, and a force couple may be created between the bowl of the basin or sink and the lower end of the leg of the clamp. The clamp structure is conveniently stamped and formed from sheet steel or other suitable material, but may be made of extruded aluminum or injection-moulded plastic.

11 Claims, 3 Drawing Figures

CLAMP ASSEMBLY FOR SELF-RIMMING SINKS OR BASINS

FIELD OF THE INVENTION

This invention relates to clamp assemblies for self-rimming sinks or basins which are mounted through an opening in a supporting counter structure or the like. In particular, this invention provides a clamp structure by which self-rimming sinks may be easily installed without the necessity for special tools or handling.

BACKGROUND OF THE INVENTION

For many years now, basins that are installed in bathroom vanity counters and the like, and kitchen sinks, have for the most part been of the self-rimming variety. That is, the rim of the basin or sink is held down by one or another means against the upper surface of the vanity or counter, and sealed against it, to prevent leakage and also for purposes of styling and appearance. Bathroom basins of the self-rimming variety are generally enamelled steel or vitreous china, whereas most kitchen sinks are formed of monel or stainless steel. Most of such basins and sinks are drawn and then stamped using conventional drawing and staping techniques; and indeed, many kitchen sinks are formd with two bowls adjacent to each other.

There have been two general means by which self-rimming sinks and basins have been mounted in and secured to a counter or vanity; and they have been either by mounting off the rim or off the bowl. No matter which manner of mounting is used, there must be some specific design features of the sink or basin by which the clamping structures may be fitted to and co-operate with the sink or basin to effect the clamped and secure mounting. This is, however, especially true for sinks or basins which are mounted off the rim, rather than with respect to sinks or basins which are mounted off the bowl.

The following discussion is particularly related to self-rimming sinks, but it will be clearly understood that the discussion is equally as applicable to self-rimming basins.

In any event, as mentioned, it is generally accepted that sinks or basins that are mounted off the rim require special design so as to accommodate or co-operate with the clamping structure. For example, typical clamping structures for self-rimming sink structures, each of which requires a special design of the sink rim—and thus requires considerable extra costs for manufacture—are shown in RICHARDSON U.S. Pat. No. 2,925,609, issued Feb. 23, 1960 and JUST U.S. Pat. No. 3,020,563 issued Feb. 13, 1962. In each of those patents, there is taught a structure which has a clamping member having an arm through which a bolt is threadably passed to interfere with the under surface of the counter in which the sink is mounted. The clips have ends that co-operate with specially designed and shaped structures that are formed or welded into the sink structure.

A more usual way of mounting sinks, at least in the Canadian market and in increasing numbers elsewhere, is for a number of brackets to be welded around the periphery of the bowl (or bowls) of the sink structure, to which a small clip is fitted. The clip that is generally used is that which is particularly illustrated in HARTOG U.S. Pat. No. 2,846,695, dated Aug. 12, 1958. That clip simply comprises an L-shaped element having a leg which passes into an opening of a bracket, and a leg through which there is threadably engaged a bolt which may be tightened against the under surface of the counter.

A further, slightly different arrangement that is also used, comprises an injection moulded plastic clip having a clamping lip which is adapted to fit over the edge of a clamp, and having a generally horizontally extending arm through which a bolt (also plastic) is threadably passed.

However, by such Hartog or similar clip has had a number of disadvantages, until the provision of the present invention. Most of those disadvantages arise from the fact that the bolt is generally in fairly close proximity to the bowl of the sink (or basin), creating very limited working space within which the bolt may be tightened—indeed, as is clearly illustrated in the Hartog patent. Moreover, since the opening through which a sink is fitted may sometimes be not wholly accurate, and especially it may be over-sized, so that the cup at the top of the bolt which passes through the horizontal arm of the Hartog clip may only engage with half or less of its area against the underside of the counter structure at the edge of the opening therein. Attempts to increase the distance from the bowl of the sink at which the bolt passes through the arm have given rise to other difficulties, notably that the initial mounting of the clip and beginning the engagement of the bolt to the under surface of the counter is difficult. Still further, it has been found that over-tightening of the bolt against the under surface of the counter may create forces in the side of the bowl at the bracket, whereby the bowl of the rim may be distorted or, in extreme cases, the bracket become loosened if the welding by which it has been secured to the bowl has not been well made.

It has thus become a principal purpose of this invention to provide an improved clamping structure, particularly for use in clamp assemblies whereby self-rimming sinks or basins may be mounted through an opening in a supporting counter structure or the like, and which overcomes the faults and shortcomings of previous structures. Moreover, the present invention serves to provide a clamp structure which may be easily and inexpensively produced, and which provides a secure clamping assembly by which the sink or basin is easily but securely mounted.

To effect these advantages, the present invention therefore provides a clamp assembly which is intended for use with self-rimming sinks or basins as discussed above, where the sink or basin has a bowl and a plurality of brackets secured at least intermittently around the outer surface of the bowl at positions which are neither at the top nor the bottom of the bowl—i.e., at positions which are intermediate the height of the bowl. Each of the brackets is, of course, understood to have a downwardly facing opening from the top thereof, but is usually entirely open from top to bottom, where the opening is adjacent the outer surface of the bowl of the sink or basin, at the bracket.

To co-operate with the brackets, or at least some of them depending on certain aspects of the mounting of the sink or basin as discussed hereafter, there is provided a generally L-shaped clamp structure which has a first, generally horizontally disposed arm, and a second, generally vertically disposed leg which depends downwardly from the arm. A bolt is threadably received in and passed substantially perpendicularly through the horizontal arm, and the bolt has engageable means at the lower end thereof by which the bolt may be turned. Means are also provided at the upper end of the bolt for engaging the under surface of the supporting counter structure or the like, through an opening of which the sink or basin is being mounted.

A clamp arm is provided in the generally L-shaped clamp structure, spaced from the side of the leg which is opposite the generally horizontally disposed arm. The clamp arm is such that it depends downwardly from a clamping shoulder which is upstanding from the leg, and the clamp arm is substantially parallel to the contiguous portions of the leg of the clamp structure and is spaced from those contiguous portions of the clamp structure a sufficient distance to accommodate one of the brackets fixed to the side of the sink or basin being mounted.

The lower portion of the leg is offset from the upper portion in a direction away from the generally horizontally disposed arm of the clamp, to an extent that it will contact the outer surface of the bowl at a place below the bracket with which the clamp arm is engaged, so that the bolt is maintained in a substantially vertical orientation.

Additionally, of course, sufficient space is provided at the bottom end of the bolt so that the bolt may be easily and conveniently turned into engagement at its upper end with the under surface of the supporting structure.

BRIEF DESCRIPTION OF THE DRAWINGS

Specific features of the clamp assembly, and particularly the clamp structure, according to the present invention, are discussed in greater detail hereafter, in association with the accompanying drawings, in which.

DESCRIPTION OF THE PREFERRED EMBODIMENTS

Figure 1:
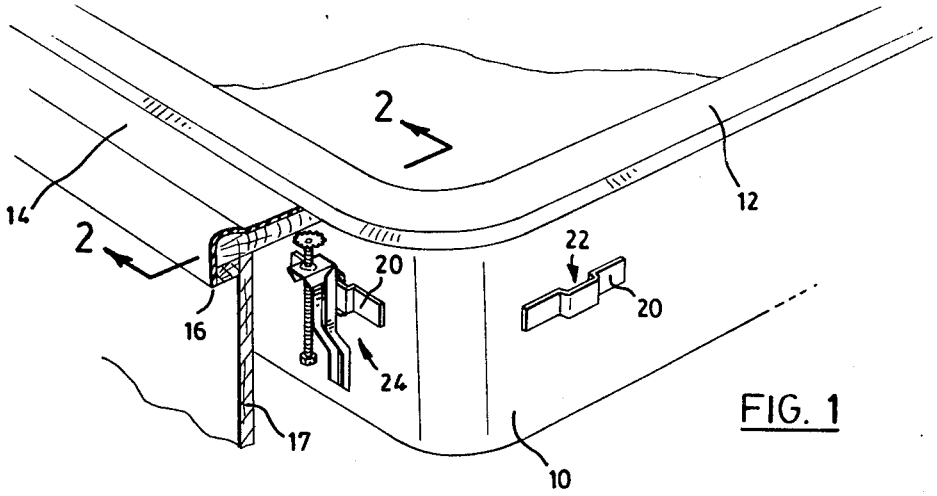
FIG. 1 is a partial perspective showing the corner of a sink or basin, and a cut away portion of a supporting structure, showing a clamp structure in place.

As stated above, the present invention is particularly directed towards a clamp assembly for use with self-rimming sinks or basins, where the sink or basin is intended for mounting through an opening in a supporting counter or vanity structure, or the like. Accordingly, there is shown (for purposes of this discussion) a sink 10 having a rim structure 12, and adapted to be fitted through an opening in a counter structure 14. Usually, the supporting counter structure or vanity has an upper laminated surface covering of a hard and easily cleaned material such as Arborite (trade mark) shown generally at 16, and may have a front face 17. When the sink 10 is mounted through an opening in the counter structure 14, it is usual that a bead of caulking 18 be placed around the underside of the edge of the rim structure 12, to preclude leakage of splashed water or the like past any irregularities that there may be in the rim structure or counter surface.

At various points around the outer periphery of the sink 10, there are secured a number of brackets 20. Generally, each bracket 20 is spot welded to the outer surface of the sink (or basin), and is formed from a bracket strip so as to have a downwardly facing opening from the top thereof, indicated at 22. Because the sink or basin 10 may be mounted next to other structures, or indeed the sink may be a double-bowl structure, there are generally provided more brackets 20 than will be actually used for securing the sink in place, so that the plumber or other craftsmen who is mounting the sink or basin may choose the most convenient brackets that are accessable and which provide a secure mounting.

To effect the mounting of the self-rimming sink or basin, the clamp assembly includes not only the bracket 20 with the opening 22, but a clamp structure generally indicated at 24. The clamp structure 24 co-operates with the bracket 20, as more particularly described hereafter.

Broadly stated, the clamp structure 24 has a first, generally horizontally disposed arm 26, and a second, generally vertically disposed leg 28 which depends downwardly from the arm 26. A bolt 30 is threadably received in and passes substantially perpendicularly through the arm 26, and has engageable means such as a bolt head 32 at its lower end by which the bolt 30 may be turned. Alternatively to the bolt head 32, the bolt 30 may be a winged bolt, with a wing or wings at its lower end.

At the upper end of the bolt 30, there are means 34 provided for engaging the under surface of the supporting counter structure 14. In general, those means are such as an upwardly facing cup washer having a serrated periphery, or it may be other means as discussed hereafter.

A clamp arm 36 is spaced away from the contiguous portions of the leg 28 near the upper end thereof, and depends downwardly from a clamping shoulder 38 which is upstanding from the leg 28. The clamp arm 36 is substantially parallel to the contiguous portions 40 of the leg 28; and as seen in FIG. 2, the clamp arm 36 is spaced away from those contiguous portions 40 of the leg 28 a sufficient distance so as to accommodate the bracket 20 beneath the clamping shoulder 38.

The lower portion of the leg 28, designated at 42, is offset from the upper portion of the leg 28 in a direction away from the arm 26. The amount of offset of the lower portion 42 of the leg 28 may vary, depending on whether the clamp structure 24 has been specifically designed for a specific sink or basin. However, in general, the amount of draft of a wall of a sink, for example, is reasonably standard so that the amount of offset can be a standard amount for fitting the clamp structure to a variety of different sinks or basins, indeed as may be supplied to the market by different manufacturers.

In any event, the offset is to an extent that the outer surface of the portion 42 of the arm 28 will contact the outer surface of the wall of the bowl at a place below the bracket 20 with which the clamp arm 36 is engaged, so that the bolt 30 is kept in a substantially vertical orientation.

Figure 2:
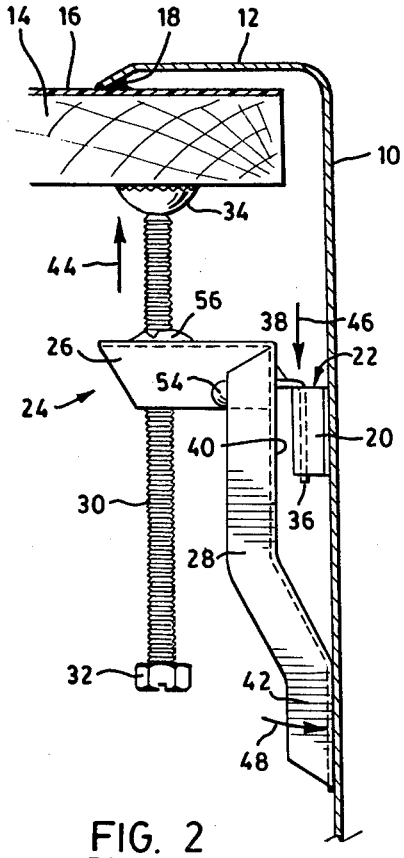
FIG. 2 is a side view to a larger scale of the clamping assembly according to the present invention.
Figure 3:
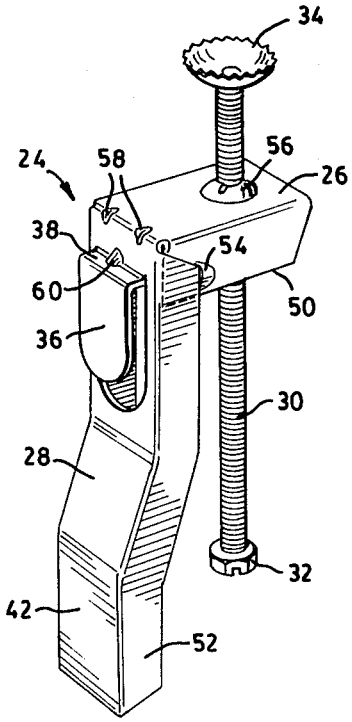
FIG. 3 is a perspective view of a perferred embodiment of a clamp structure according to the present invention.

As can be seen particularly from FIGS. 2 and 3, as the bolt is turned so that the cup 34 engages the under surface of the counter or supporting structure 14, with an upwardly directed force as at arrow 44, a downwardly directed force is generated at the interface between the clamping shoulder 38 and bracket 20, as indicated by arrow 46. Moreover, by maintaining the lower portion 42 of the leg 28 against the wall of the sink 10, as indicated by arrow 48, there is an assurance that the bolt 30 is maintained substantially vertically to the arm 26, and thus also substantially vertically to the under surface of the counter structure 14. The forces generated as shown at arrows 44 and 46 thereby assure that the sink is securely mounted, without creating a skewing force against any portion of the sink 10. The seal of the lip 12 at the caulking 18 over the surface 16 of the counter 14 is also more assured.

The following discussion is directed to several specific features and embodiments, and alternative features and embodiments, of the clamp structure 24.

Firstly, it should be noted that the clamp structure 24 may be formed of a number of different suitable kinds of material, although the specific clamp structure which is illustrated in the drawings is of one which may be formed from a single piece of sheet steel or other suitable material, and is therefore inexpensive to manufacture as compared with certain other materials referred to. For example, the clamp structure 24 could be formed of an injection moulded plastic, or it may be formed from an extruded aluminum. In the latter case, the cross-section of the arm 26 and leg 28, and of the clamping arm 36 and clamping shoulder 38, would each be substantially constant—although, of course, not necessarily equal to each other—so that each clamping structure 24 would be formed by cutting a length of extrusion equal to the width of the clamp structure 24, as desired. Where the clamping strucure is formed from extruded aluminum, at least one additional machining operation would be required, to provide a threaded or tapped hole through the arm 26 so as to threadably receive the bolt 30.

In a preferred embodiment, particularly as illustrated, the clamp assembly is more inexpensively produced by being stamped and formed from a single piece of sheet steel or other suitable material, following which it may be tumbled and plated so as to remove all sharp edges and to provide an appropriate surface for contact against the outer surface of a sink or basin.

Generally, in such circumstances, the arm 26 and leg 28 each has a generally U-shaped cross-section, with the sides of each of the U-shaped configurations being substantially straight. Thus, the arm 26 may have side portions 50, and the leg 28 may have side portions 52. The clamping structure may be conveniently formed with the side portions 52 of the leg 28 overlying the side portions 50 of the arm 26, in the vicinity of the junction between the leg 28 and the arm 26.

To provide additional strength, so as to preclude a tendency of the arm 26 to fold toward the leg 28 if the bolt 30 is overly tightened, the edges of the sides 52 of the leg 28 which overly the sides 50 of the arm 26 may abut against dimples 54 which may be formed by lancing the sides 50 of the arm 26 in the appropriate places.

Still further, the ends of the sides 50 of the arm 26 which underly the sides 52 of the leg 28, at the junction thereof, may abut the inside surface of the leg.

When the clamp structure 24 is formed from a piece of sheet steel, it is convenient that the bolt 30 is threadably received in the arm 26 of the clamp structure 24, by means of a helix thread collar 56 which is formed therein.

Further, to provide additional stiffening both at the junction of the leg 26 with the arm 28, or at the place where the clamping shoulder 38 is upstanding from the arm 28, at least one stiffening rib 58 or 60 may be formed by a suitable stamping operation.

Also, whether the clamp structure 24 is made from a single piece of sheet steel or other suitable material, or is formed of extruded aluminum, or has been injection moulded from a suitable plastics material, the means at the upper end of the bolt 30 which co-operates with the under surface of the counter structure 14 may be an upwardly facing cup washer having a serrated periphery, as indicated, or it may be a moulded plastic plug-like member which may have an upper surface with upwardly facing protrusions formed therein.

There has been described a clamping assembly for mounting self-rimming sinks or basins through an opening in a supporting counter structure, or the like, where a clamp structure having an arm and a leg, with the lower portion of the leg offset away from the arm, and having a clamping arm and shoulder in the upper portion of the leg, co-operates with a bracket formed intermediate the height of the sink or basin to be mounted. The clamp arm is received in a downwardly facing opening of the bracket, and a bolt which is threadably received in the arm of the clamp structure is maintained in a substantially vertical orientation as the clamp assembly is tightened by turning the bolt so as to secure the sink or basin in place.

It has been noted that the clamping structure may conveniently and inexpensively be formed by stamping the same from a single piece of sheet steel or other suitable material; but the clamping structure may also be formed from extruded aluminum, or it may be injection moulded from a suitable plastics material.

While the drawings and description have been particularly related to a preferred embodiment of the clamping structure, showing it in a co-operating manner with a bracket formed on the outer surface of the bowl of a sink, it is clear that other changes to the design or specific features of the clamping structure or the assembly may be made without departing from the spirit and scope of the appended claims.

What is claimed is:

1. A clamp assembly for use with a self-rimming sink or basin intended for mounting through an opening in a supporting counter structure which has an upper surface over which the rim of said sink or basin will fit, and having an under surface, where said sink or basin has a bowl and a plurality of brackets secured at least intermittently around the outer surface of said bowl at positions intermediate the height of said bowl, and where each of said brackets has a downwardly facing opening from the top thereof adjacent the outer surface of said bowl at said bracket, comprising:

a generally L-shaped clamp structure having a first, generally horizontally disposed arm, and a second, generally vertically disposed leg depending downwardly from said arm;

a bolt threadably received in and passed substantially perpendicularly through said arm, and having engageable means at the lower end of said bolt by which said bolt may be turned, and means at the upper end of said bolt for engaging the under surface of said supporting structure;

and a clamp arm spaced from the side of said leg opposite said arm, and depending downwardly from a clamping shoulder upstanding from said leg, said clamp arm being substantially parallel to the contiguous portions of said leg and being spaced therefrom a sufficient distance to accommodate one of said brackets;

where the lower portion of said leg is offset from the upper portion thereof in a direction away from said arm and to an extent that it will contact the outer surface of said bowl at a place below the bracket with which said clamp arm is engaged, and so as to keep said bolt substantially in a vertical orientation.

2. The clamp assembly of claim 1, where each of said arm and said leg have a generally U-shaped cross-section, with substantially straight sides.

3. The clamp assembly of claim 2, when formed from a single piece of sheet steel or other suitable material.

4. The clamp assembly of claim 1, where said clamp structure is formed of extruded aluminum by which the side profile of said clamp structure is determined by extrusion.

5. The clamp assembly of claim 3, where the sides of said leg overlie the sides of said arm in the vicinity of the junction between said leg and said arm.

6. The clamp assembly of claim 5, where the edges of said sides of said leg which overlie the sides of said arm are abutted against dimples formed in the respective sides of said arms.

7. The clamp assembly of claim 6, where the ends of the sides of the arm which underlie the sides of the leg at the junction thereof abut the inside surface of said leg.

8. The clamp assembly of claim 2 or 4, where said means at the upper end of said bolt is rotatably captured thereat, and is an upwardly facing cup washer having a serrated periphery.

9. The clamp assembly of claim 2 or 4, where said means at the upper end of said bolt is rotatably captured thereat, and is a moulded plastic plug-like member having an upper surface with protrusions formed therein.

10. The clamp assembly of claim 3, where said bolt is threadably received in said arm by means of a helix thread collar formed therein.

11. The clamp assembly of 3, 6 or 7, where at least one stiffening rib is formed at the junction of said arm and said leg, and at least one stiffening rib is formed in said clamping shoulder.

* * * * *